US006460224B1

(12) United States Patent
Hesch

(10) Patent No.: US 6,460,224 B1
(45) Date of Patent: Oct. 8, 2002

(54) DEVICE AND METHOD FOR PRODUCING A FIBER COMPOSITE

(76) Inventor: Rolf Hesch, Steinkamp 2c, D-32657, Lemgo-Luerdissen (DE)

( * ) Notice: Subject to any disclaimer, the term of this patent is extended or adjusted under 35 U.S.C. 154(b) by 0 days.

(21) Appl. No.: 09/622,197

(22) PCT Filed: Feb. 12, 1999

(86) PCT No.: PCT/DE99/00432

§ 371 (c)(1),
(2), (4) Date: Aug. 14, 2000

(87) PCT Pub. No.: WO99/41439

PCT Pub. Date: Aug. 19, 1999

(30) Foreign Application Priority Data

Feb. 16, 1998 (DE) ..... 198 05 996

(51) Int. Cl.[7] ..... D01G 13/00
(52) U.S. Cl. ..... 19/145.5; 19/301; 19/302
(58) Field of Search ..... 19/145.5, 65 R, 19/80 R, 85, 87, 90, 91, 93, 94, 97, 97.5, 144, 145, 145.3, 296, 301, 302, 305, 306; 156/62.2, 322, 499; 162/251; 209/17, 135, 138, 139.1; 406/98, 106, 168, 12; 425/80.1, 82.1, 83.1, 363, 371

(56) References Cited

U.S. PATENT DOCUMENTS 3,340,127 A * 9/1967 Buerkner ..... 156/322
3,645,457 A * 2/1972 Greten et al. ..... 19/145.5
4,057,876 A * 11/1977 Sawyer ..... 19/80 R
4,063,858 A * 12/1977 Axer et al. ..... 425/80.1
4,494,919 A * 1/1985 Knudson et al. ..... 425/83.1
4,766,648 A * 8/1988 Kerley ..... 19/80 R
5,104,703 A 4/1992 Rachman et al.
5,445,777 A * 8/1995 Noel et al. ..... 425/81.1
5,496,570 A * 3/1996 Mauss et al. ..... 425/83.1
5,873,150 A * 2/1999 Gerard ..... 19/301

FOREIGN PATENT DOCUMENTS

| | | |
|---|---|---|
| DE | 38 32 098 | 5/1989 |
| DE | 41 28 592 | 3/1993 |
| DE | 41 36 891 | 5/1993 |
| DE | 297 17 589 | 1/1998 |
| EP | 0 344 365 | 12/1989 |
| GB | 2 010 347 | 6/1979 |

* cited by examiner

*Primary Examiner*—John J. Calvert
*Assistant Examiner*—Gary L. Welch
(74) *Attorney, Agent, or Firm*—Browdy and Neimark, P.L.L.C.

(57) ABSTRACT

Method for the production of a fiber composite by placing fibers on a support, wherein long fibers are used at least as an essential component for the production of a nonwoven fabric (70). Said fibers are fed to at least one delivery head (A, A1, A2) substantially over the height of a material column and ejected in a sustantially horizontal manner therefrom. A long fiber-air suspension is generated by adding at least one aggregate. The suspension is directly applied on the support, which is especially shaped as a molding strip (14).

23 Claims, 5 Drawing Sheets

DEVICE AND METHOD FOR PRODUCING A FIBER COMPOSITE

Figure 1:
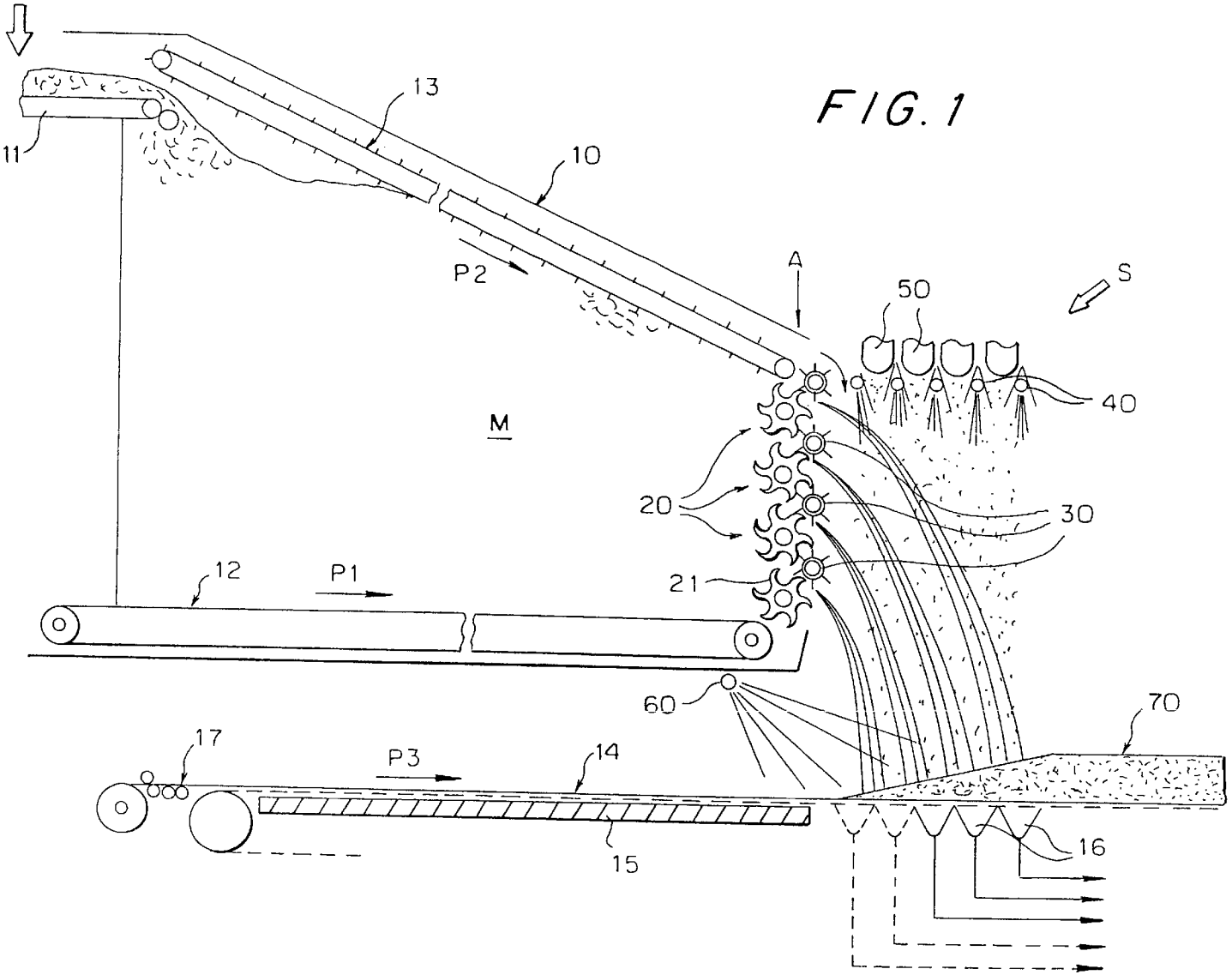

This application is the national phase of international application PCT/DE99/00432 filed Feb. 12, 1999 which designated the U.S.

FIELD OF THE INVENTION

The invention relates to an apparatus and a method for producing a nonwoven fabric from fibers.

Such nonwoven fabrics are used in particular for producing compression-molded parts, insulating mats, and upholstery material.

PRIOR ART

Essentially two methods and corresponding apparatuses are known for producing such nonwoven fabrics: forming a nonwoven fabric by means of carding/combing machines, and aerodynamic nonwoven fabric forming systems.

The disadvantages of both systems are low or even very low throughputs and thus high costs, as well as the necessity of using at least extensively cleaned fibers that are free of foreign bodies and have been opened and that are therefore expensive.

Although carding/combing machines are capable of producing especially fine, uniform nonwoven fabrics, nevertheless they make the most stringent demands in terms of freedom from shives and the degree of opening of the fibers. Their production output, at a maximum of 500 kg/h, is very low, and the costs are correspondingly high.

If bast fibers that still contain shives are processed, for instance, they catch on the card clothings of carding/combing machines or become deposited in the bores of holes of the screen drums or screen belts of aerodynamic nonwoven fabric forming systems and hinder the nonwoven fabric formation considerably, even to the extent of complete inoperability.

In the ensuing needling, hemp shives in particular deflect the needles from the bores in the perforated plates onto the steel plates. As a consequence, the needles break.

Aerodynamic nonwoven fabric forming systems make less stringent demands in terms of freedom from shives and the degree of opening of fibers. The output reaches about 1000 kg/h. This is still inadequate, however, to attain favorable costs from mass-produced products.

Cleaning the fibers of shives and opening the fibers are associated with high costs. Furthermore, cleaning the fibers, and especially opening them, always leads to more or less severe mechanical damage to the fibers. This entails material losses of up to 40%. In the final analysis, well-cleaned and opened fibers that thus meet these demands made of the known systems can be created only from retted hemp or flax straw. Retting, however, is a biodegrading process and thus inevitably weakens the fibers as well. For industrial purposes, fibers with maximum strength and a maximum modulus of elasticity are required.

Other systems for forming bulk goods are used for manufacturing boards of wood material; the final products are in particular particle boards that have gained extensive use in furniture making. Scattering methods are used to produce such plates, and in these methods the chips are delivered from a bunker to a feed roller head and from there are scattered onto a substrate by way of various intermediate processing stages. One such scattering method is described in German Patent Disclosure DE-A 4 128 592, which shows the closest prior art. However, this technique can be used only with chips that flow easily. The flowability of the chips has the major disadvantage, however, that hardening and compacting must be done immediately after the scattering; that is, once again, additional processing stations are required to achieve an easily handled product. The aforementioned wide range of end products (insulating materials, molded upholstery parts, compression-molded parts) cannot be made with the chip cakes produced by this method.

SUBJECT OF THE INVENTION

The object of the present invention is thus to produce nonwoven fabrics for insulating purposes, upholstery materials, and the like which are distinguished by minimal costs. In particular, the object is also to produce nonwoven fabrics from which molded parts with a high modulus of elasticity and high strength are created.

In a similar way, via the second nozzles 60, it is possible to apply a sealing agent to the nonwoven fabric 70 as it forms, or to apply an adhesive for the sake of better adhesion of the nonwoven fabric 70 to the first coating belt. A previously foamed material or an unfoamed material with an incorporated propellant may be used as the sealing agent and binds to the surface of the nonwoven fabric 70 that is to be coated.

The fundamental concept of the invention is based on the fact that minimal costs are attainable only if the number of production stages is reduced to a minimum and the throughput is maximized. Furthermore, the currently usual material losses should at least be decisively lowered.

As already mentioned above, the production stages of "separating shives" or similar substances in granulate or nodelike form that accompany fibers, and "opening" (refinement) are extraordinarily cost-intensive. Aside from the incident operating costs, the material losses that they cause have a major effect on cost.

According to the invention, nonwoven fabrics can now be produced in which the two aforementioned production stages, namely "shive separation" and "fiber opening" are no longer needed, since with this method and the corresponding apparatus according to the invention, in an extreme case even uncleaned and unopened fibers can be processed. The attendant production costs are thus dispensed with.

High fiber strength and a high modulus of elasticity are furthermore obtainable only if retting is dispensed with. Dispensing with retting, however, means that the fibers have a much high shive content and are much coarser and rougher than is required for processing as in the prior art. Once again, the invention is still usable, unlike nonwoven fabric forming systems of the prior art, which cannot function at all with unretted, uncleaned and unopened fibers.

It is especially advantageous, however, that the attendant material losses are also avoided, which in terms of cost makes even more of a difference.

The apparatus according to the invention is furthermore capable of providing a yield that is multiple times greater than in prior art systems. Costs are thus reduced to a fraction.

According to the invention, unretted, uncleaned, unopened fibers with lengths between 20 and 150 mm, preferably 30 to 70 mm, with or without shives and/or nonfibrous components that still stick to them and/or are located or scattered freely between them, with or without recycled polymer and other fibers, can thus be formed into a single- or multi-layer nonwoven fabric, and a throughput that is far above the prior art is attained, namely from 2000 to 9000 kg/h, preferably 2000 to 4000 kg/h, for a working width of 3000 mm.

However, the method according to the invention is usable when any fibers are used, even synthetic, mineral or natural fibers, including and cleaned and opened fibers, and so forth.

Figure 2:
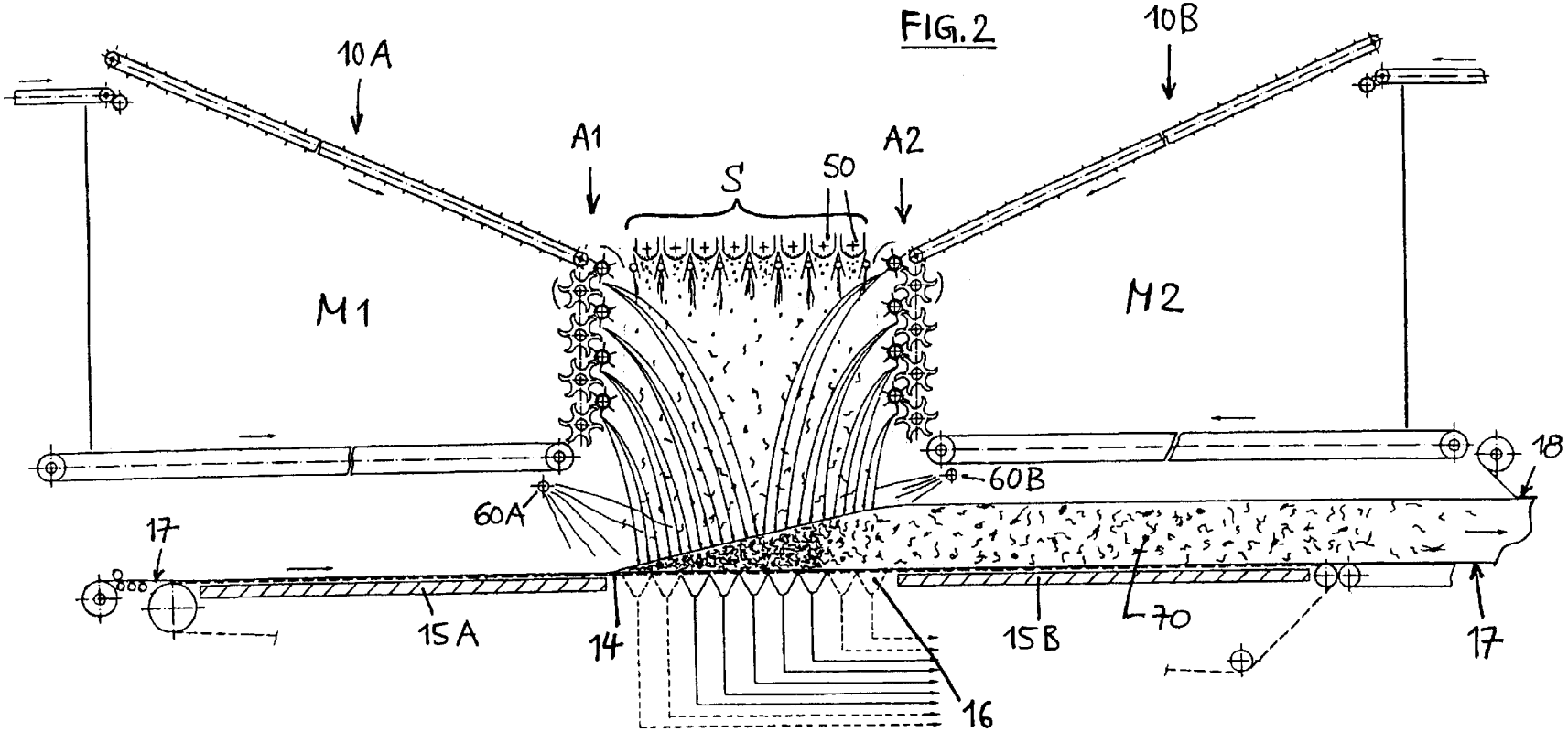
Figure 3:
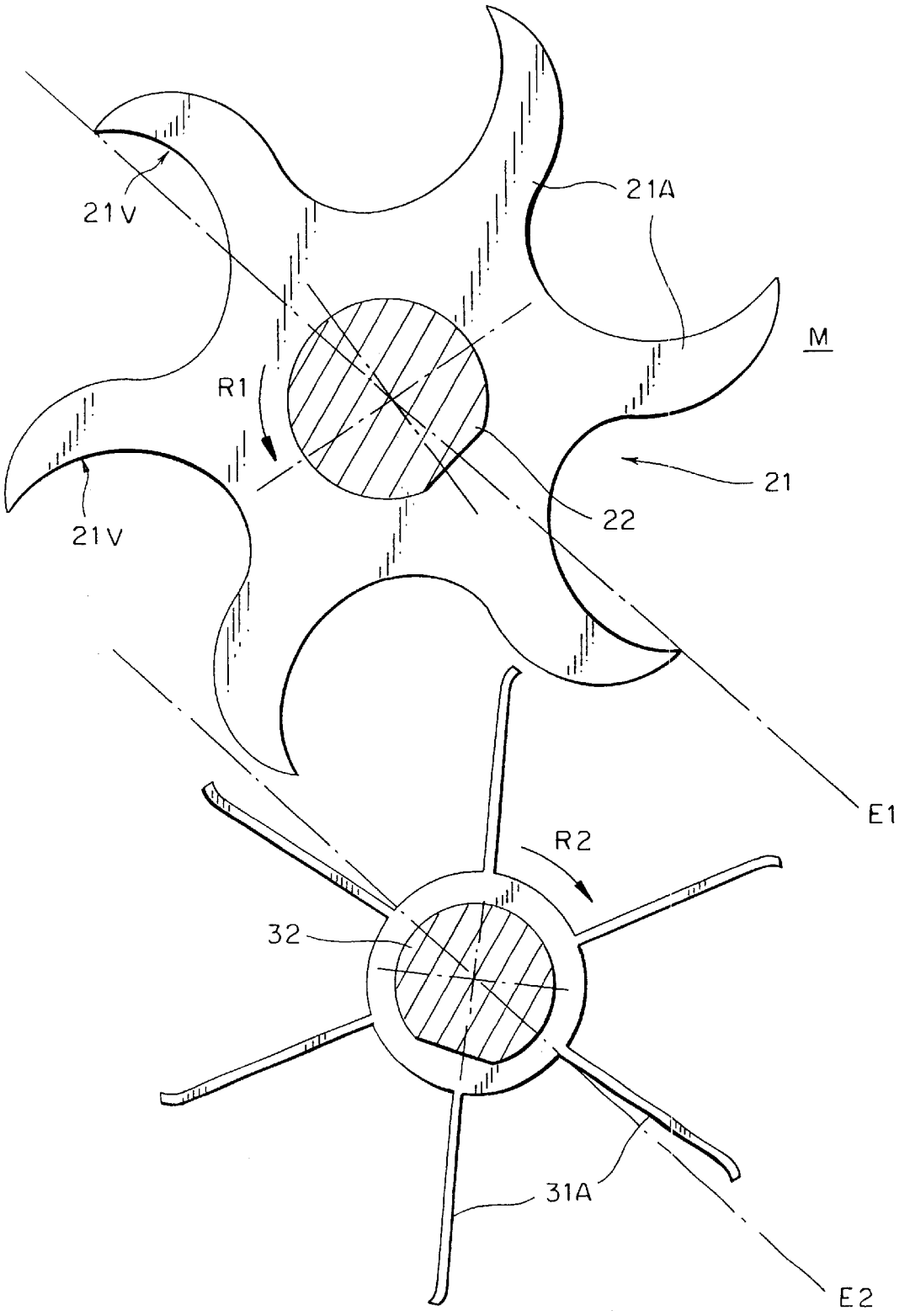
Figure 4:
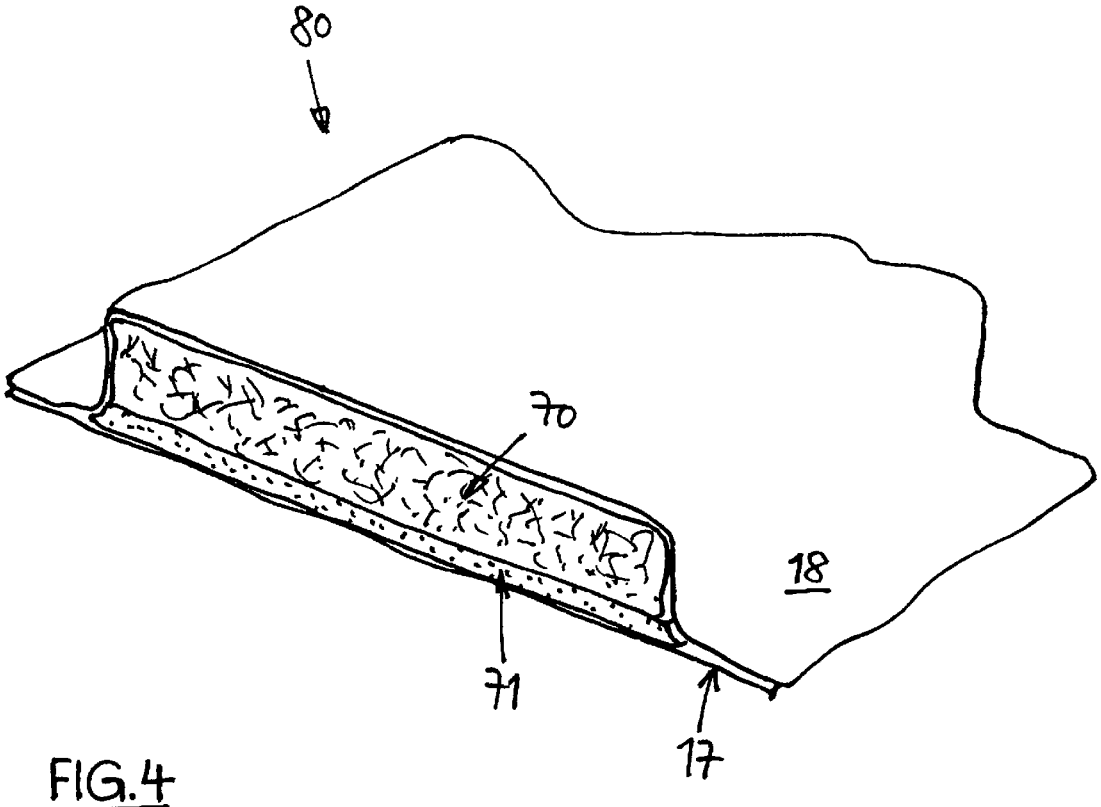

Two exemplary embodiments of the apparatus of the invention will be described in further detail in conjunction with drawings; shown are:

FIG. 1: a sectional view of a first preferred embodiment of the apparatus of the invention;

FIG. 2: a sectional view of a second preferred embodiment of the apparatus of the invention;

FIG. 3: a detailed view of the elements of the first and second discharge devices of the apparatuses of FIG. 1 or 2, and FIG. 4: a perspective view of an exemplary embodiment of a composite element produced with the apparatus of the invention.

Figure 5:
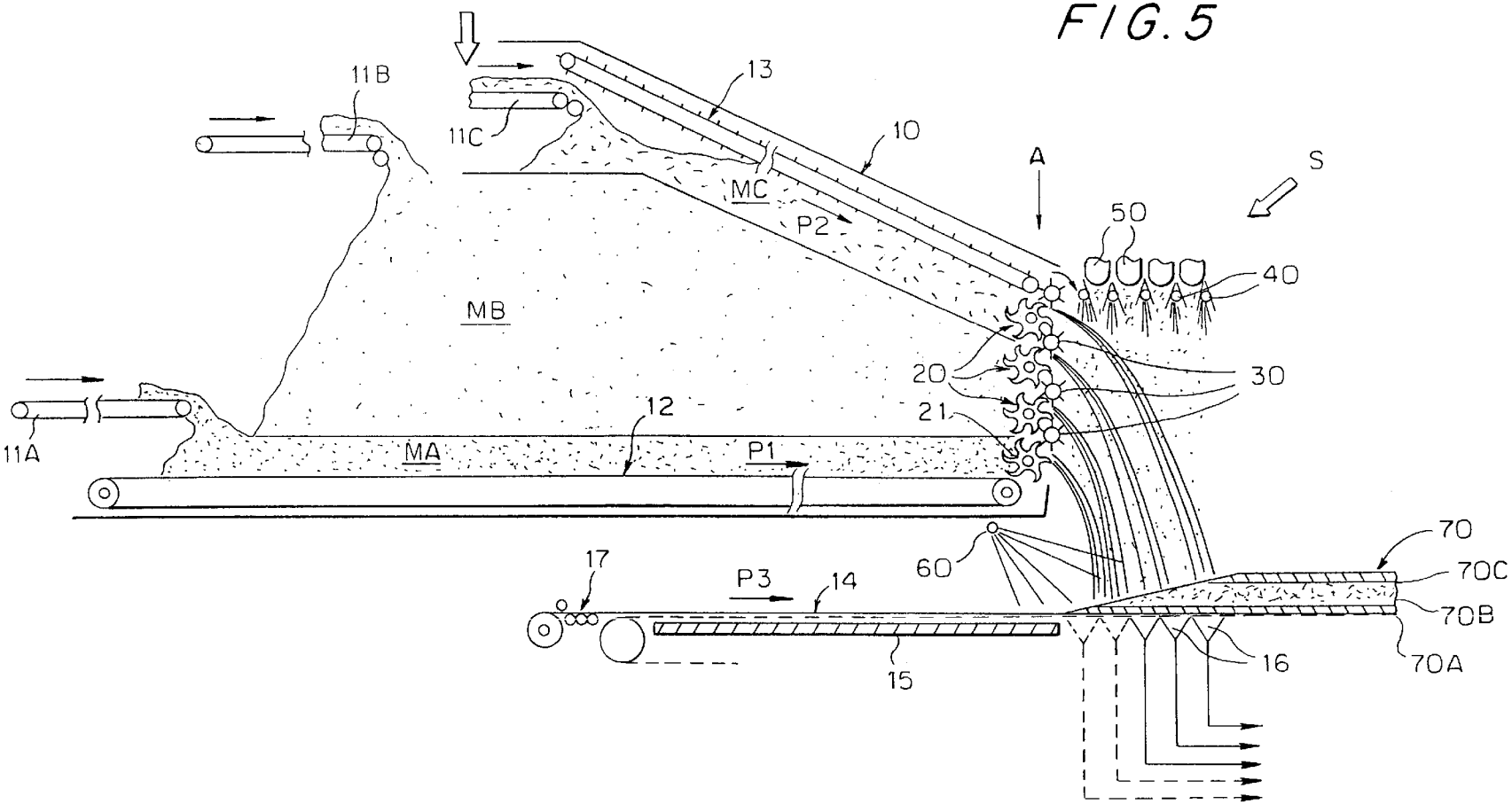

FIG. 5: a sectional view of a third preferred embodiment of the apparatus of the invention.

The exemplary embodiment shown in FIG. 1 of an apparatus for applying fibers to a forming belt to produce a fiber composite includes an intermediate storage means in the form of a metering bunker 10, in which the fibers with lengths between 20 and 150 mm, hereinafter also called long fibers, together with optional additives, are introduced via a transverse distributor 11. The bottom of the metering bunker 10 is formed by a bottom belt 12, which moves in the direction of the arrow P1 shown in FIG. 1, so that a material column M forms that is moved by the motion of the bottom belt 12 in the direction of a discharge head A. To this extent, the structure of the metering bunker corresponds to embodiments of the kind known from German Patent Disclosure DE-A 1 084 199 or Swiss Patent Disclosure CH-A 368 301, for purposes not described in further detail there.

A compacting belt 13 leading obliquely downward is disposed on the top side of the metering bunker 10 and moves in the direction of the arrow P2, or in other words in the same direction as the bottom belt 12. The feeding speeds of the transverse distributor 11, bottom belt 12, and compacting belt 13 are adapted to one another in such a way that the material column M builds up between the top side of the bottom belt and the underside of the compacting belt and is compacted by the latter belt. The bottom belt 12 is defined on both long sides and on its back side by suitably high walls, so that the material column M, made up of long fibers and optionally their loading materials and supplemental materials, assumes a substantially square or rectangular cross section and is thrust continuously against the discharge head A, bringing about the aforementioned compacting.

The discharge head A comprises first discharge devices 20, which point toward the material column M, and downstream second discharge devices 30 that cooperate with them and that point toward the discharge side of the discharge head A.

The first discharge devices 20 comprise many shafts 22 (FIG. 3), preferably disposed vertically one above the other, on which laterally spaced-apart star wheels 21 are retained, whose elements 21A point substantially radially to the shaft 22 and whose front flanks 21V are embodied in hook-shaped or crescent-shaped fashion in the direction of rotation are one.

The second discharge devices 30 also comprise shafts 32 disposed vertically one above the other, in such a way that the connecting planes E1, E2 of the shafts 22 and 32 of the two discharge devices 20 and 30 are parallel to one another. Star-shaped and/or thorn-shaped elements 31A are retained on the shafts 32 of the second discharge devices 30 and rotate in the direction R2; the directions of rotation R1, R2 of the shafts of the first and second discharge devices are contrary to one another. The elements 21A and 31A are adapted to one another in terms of their number and shaping in such a way that their respective operative regions mesh with one another.

On the discharge side of the thus-formed discharge head A, a suspension chamber S is provided, whose upper boundary is formed by first nozzles 40 and solids distributors 50. The nozzles 40 serve to introduce liquid loading materials into the suspension chamber S.

A forming belt 14 is guided below the suspension chamber S over a support table 15 and is moved in the direction of the arrow P3. On this continuously advancing forming belt 14, the long fibers discharged by the discharge head A are deposited in the form of a long fiber and air suspension, so that depending on the operating parameters of the apparatus, a nonwoven fabric 70 of adjusting thickness and consistency forms on the forming belt.

Negative-pressure chests 16 can affect the composition and consistency of this nonwoven fabric.

In the region below the discharge head A, second nozzles 60 are provided, with which a sealing agent can for instance be applied to the nonwoven fabric as it forms.

In the preferred embodiment shown, above the forming belt 14, a first coating belt 17 is additionally guided; it serves as a carrier layer or cover layer or barrier layer of the nonwoven fabric.

First, the basic function of this apparatus will be explained:

The starting material or basic material of the nonwoven fabric 70 to be formed is placed on the transverse distributor 11; according to the invention, this starting material contains long fibers in particular, that is, fibers with lengths preferably between 30 and 70 mm, which in turn can preferably comprise such natural fibers as hemp fibers or flax fibers, and which are uncleaned. These long fibers can be placed exclusively on the transverse distributor 11, or they can be components of a mixture in which granular components, in particular such as shives but also polymer elements, wood granulates, and recycling foams, occur; that is, by the choice of the composition of the starting material placed on the transverse distributor 11, the fundamental nature of the nonwoven fabric produced in the apparatus of the invention is at least partly predetermined.

In particular, it is possible and desirable here for the long fibers to be a component of a composite of natural long fibers and shives, in which the natural fibers and the shives are still intertwined over part of their length, or in other words are in the state in which as yet none of the cost-intensive additional processing steps described at the outside have been performed.

These long fibers now by themselves or together with the aforementioned mixture components form the content of the metering bunker 10 as it slowly fills, and consequently they pass to the discharge head A, whose structure has been explained above. The described elements 21A, 31A of the first and second discharge devices act as milling devices, which rip or tear the long fibers or bundles of long fibers and the substances or materials accompanying them out of the matted material column M.

The longer the long fibers are and the more severely they are matted, the more difficult does their passage through the discharge head to the outside become; in this decisive region, the risk of clogging increases sharply with increasing fiber length, an increasing degree of matting and tangling, and especially with an increasing proportion of shives that are not completely separated from the long fibers. A particular hindrance results from the admixture of thicker and therefore stiffer polymer fibers, with the result that unless additional provisions are made, the discharge output decreases accordingly, until the first discharge devices 20 are completely clogged. Consequently, the function of the second discharge devices 30 is an especially significant supplementation to the function of the first discharge devices 20, which is structurally decisive for the desired goals, because the elements 31A provided in them accomplish the clearing, loosening and acceleration of the long fibers engaged by the first discharge devices 20, and thus especially with material that mats heavily, they make the overall function of the discharge head A possible for the first time, by effectively preventing clogging.

In the especially advantageous exemplary embodiment shown, the two planes E1, E2 (FIG. 3) of the shaft groups 22, 32 of the first and second discharge devices are disposed vertically; the elements of the second discharge devices 30 that act as clearing and accelerating rollers, in the exemplary embodiment shown, have hooklike or crescent-shaped ends that are oriented slightly forward and that perform a plurality of functions:

First, with increased rpm, they reach between the elements 21A of the first discharge devices 20 and in an accelerated way rip out the material that is located in the discharge area and contains the long fibers. This greatly accelerates the passage of the long fiber material through the rotating elements 21A, reliably prevents clogging and tangling, and thus increases the capacity of the entire system. It is self-evident that the form of the elements 21A and 31A of the two discharge devices can be optimized to a certain extent, in terms of the long fiber material currently being processed, by suitable shaping; many variants are conceivable, ranging from sharply curved, crescent-like shapes to pinlike or thornlike shapes, especially since such variants can also be designed structurally to be interchangeable.

Clumping of the fibers that might occur can also be completely reversed by an increased rpm of the elements 31A of the second discharge devices 30; this is of particular significance for the quality of the nonwoven fabrics in terms of their strength and also the homogeneity in terms of the distribution of weight per unit of surface area.

The rotary speeds of the shafts 32 can be adjusted infinitely variably in the range from 150 to 1500 rpm, for instance, so that the long fiber elements that have been ejected move in a kind of ejection parabola path away from the discharge side of the discharge head A. The "ejection range" and hence the depth of the adjoining suspension chamber S, and naturally thus the consistency of the developing nonwoven fabric 70 as well, can be predetermined by the choice of the rpm of the shafts 32.

For a still more-extensive definition of the "ejection paths" of long fiber elements discharged in discharge devices disposed one above the other, the individual shafts, disposed one above the other, of the second discharge devices 30 can be operated at a variably high rpm, for instance with an rpm that increases toward the top, so that the long fiber material is spun only slightly away from the lower acceleration plane, while the long fiber material is spun away from the fastest, topmost roller 32 in a wide ejection parabola and rendered turbulent. Thus all the long fiber material can be pulled farther apart and loosened up to form a very loose long fiber and air suspension.

Controlling these events and thus varying the consistency and the density distribution of the spun-off long fiber elements are of particular significance for the addition of liquid loading materials, in particular, that are to be added to the long fibers or the mixture components, as will now be explained:

In contrast to short fibers of up to about 20 mm in length, the long fibers processed here cannot be acted upon by binders or other additives before the nonwoven fabric formation. In the liquid state, the fibers would become too soft and would therefore stick to the discharge devices 20 and 30, so that proper nonwoven fabric formation would no longer be possible. Dry adhesives or other additives would not even stick to long fibers in the first place. According to the invention, liquid binders and additives are therefore not introduced, via the first nozzles 40, until after the long fiber material has emerged from the discharge head A, so that binding or admixing of such components with the long fiber elements and the mixture components optionally added to the long fiber elements beforehand takes place only immediately in the course of the nonwoven fabric formation; that is, the liquid binders, additives or foams are sprayed or dripped into the loose long fiber and air suspension in the desired quantitative ratio via the first nozzles 40.

This system can logically also be used for introducing solid loading materials, such as additional shives, granulates or powdered binders, for which purpose solids distributors 50 are provided, which in the exemplary embodiment shown are disposed above the suspension chamber S in alternation with the first nozzles 40.

Thus the first nozzles 40 and solids distributors 50 form a kind of "curtain" of the various desired liquid or solid loading materials into the nonwoven fabric 70 forming on the forming belt 14, in such a way that a largely homogeneous buildup of the nonwoven fabric 70 from the basic materials, long fibers and loading components, is attained, regardless of whether these components are already applied to the transverse distributor 11 in a suitable form together with the long fibers, or are expediently or necessarily applied by the nozzles 40 or the solids distributors 50 in the event that they might excessively hinder the feeding of the material column M through the discharge head A.

The addition of the loading materials will therefore expediently be optimized in this respect in such a way as to attain maximum discharge capacities of the apparatus.

In principle, it is possible to have the nonwoven fabric 70 be built up directly on the forming belt 14, but in the exemplary embodiment shown in FIG. 1, a first coating belt 17 is guided above the forming belt 14; depending on the choice of material, the coating belt can be selected merely as a substrate, or view of the later intended use of the nonwoven fabric, it can be selected from paper or plastic film with various functions, such as a barrier layer.

In a similar way, via the second nozzles 60, it is possible to apply a sealing agent to the nonwoven fabric 70 as it forms, or to apply an adhesive for the sake of better adhesion of the nonwoven fabric 70 to the first coating belt. A previously foamed material or an unfoamed material with an incorporated propellant may be used as the sealing agent and binds to the surface of the nonwoven fabric 70 that is to be coated.

The forming belt 14 can be used in an air-impermeable version, or (as shown) in an air-permeable version (a screen belt); in the latter embodiment, the negative-pressure chests 16 between the forming belt 14 serve to smooth the severe turbulence of the long fiber material that results at a rotary speed of the second discharge devices 30 and to improve the homogeneity of the material distribution over the transverse axis of the forming belt 14.

To increase the capacity and to create an even better-optimized nonwoven fabric structure, the following provisions are possible:

The long fibers, or the long fiber and shive composites or mixtures of long fibers with the other components in the material column M upstream of the discharge head A have very low bulk weights, predominantly between 10 and 20 $kg/m^3$, depending on the type of fiber, fiber mixture, fiber length, proportion of shives, and other components. If high throughputs are to be attained, large structural heights of the apparatus according to the invention for the metering bunker 10 are required. To attain the throughput at lesser structural heights, first the compacting belt 13 can be used, and over its length and angle of inclination the bulk density can be increased to a multiple of the initial value sought, to such an extent that satisfactory operation of the discharge head for the long fiber composite currently involved is still assured.

Another option for increasing the capacity and enhancing the symmetry of the structure of the nonwoven fabric 70, or to achieve a multi-layer nonwoven fabric structure, resides in the disposition facing one another of two substantially structurally identical apparatuses, as shown in FIG. 2.

The basic structure and the basic mode of operation are as described for FIG. 1, so that only additional components and corresponding effects will now be described:

In the exemplary embodiment shown in FIG. 2, the "ejection parabolas" of the two facing discharge heads A1, A2 for long fiber elements furnished by metering bunkers 10A, 10B are selected so as not to overlap; that is, the result will be a two-layer nonwoven fabric 70, if the composition of the mixtures containing the long fibers is predetermined differently in the two material columns M1, M2. However, it is also possible to define the characteristic of the structure of the nonwoven fabric 70 by means of a concentrated cooperation of the ejection speeds of the discharge devices of the two discharge heads A1, A2 and of the effect of the negative-pressure chests 16: The negative-pressure chests 16 can be utilized for increasing the vertical acceleration component in the suspension chamber S, so that with the negative-pressure chests 16 turned on, for instance, the form of the ejection parabolas shown in FIG. 2 results, which is relatively steep, while conversely with the negative-pressure chests turned off and optionally with an increased ejection speed of the discharge devices of the discharge heads A1, A2, a complete or partial overlap of the basic materials originating in the two bunkers can occur, so that with one and the same apparatus as shown in FIG. 2, both homogeneous, single-layer nonwoven fabrics 70 and two-layer nonwoven fabrics 70 can be built up on forming belt 14, which is guided over support tables 15A, 15B, solely by controlling the aforementioned parameters.

FIG. 2 additionally shows second nozzles 60B associated with the second discharge head A2, for instance for applying a sealing agent to the top side of the developing nonwoven fabric, as well as a second coating belt 18, which can be coated onto the top of the finished nonwoven fabric 70, for instance as a barrier layer, such as plastic film or cardboard or paper, depending on the later intended use of the nonwoven fabric 70.

With the system described above and the method according to the invention, nonwoven fabrics 70 with a very wide physical bolt width can thus be made, and it should be stressed very strongly that with the method of the invention and the apparatus described, the incorporation of long fibers into such a nonwoven fabric can be mastered inexpensively, and at the same time, the physical and chemical properties of the resultant nonwoven fabric 70 can be defined with a very wide scope by the addition of suitable additives or loading materials at a suitable point, thus offering a very wide range of possible uses for a nonwoven fabric of this kind. To that end, it is naturally also possible in a known way to provide further processing stations downstream of the system of the invention, examples being a continuous-operation band press for compacting the nonwoven fabric, or a heat treatment for action on additives, such as binders, that are incorporated into the nonwoven fabric and that are then activated in order to enable putting the nonwoven fabric into its final state that is adapted to its intended use.

FIG. 4 briefly also shows an exemplary embodiment of one such end product 80; the nonwoven fabric 70 is covered on its underside by the aforementioned first coating belt 17 and on its top side and the end edges by the second coating belt 18; naturally the two coating belts 17 and 18 must then be embodied so that they overlap.

Located below the nonwoven fabric 70 is an additional layer 71, which can for instance also be embodied as a nonwoven fabric, or as an additionally foamed layer, for instance in a thickness range from 1 mm to 3 mm.

In summary, it can be stated that the method of the invention and the apparatuses provided for performing it make it possible for the first time economically to incorporate long fibers, and in particular uncleaned natural fibers, into a wide range of industrially useful end products, such as insulation mats, profiled parts, and also molded parts, which must have a high intrinsic rigidity, in each case by the addition of suitable additives. With the use especially of natural long fibers in the uncleaned state, a previously impossible but highly desirable combination of ecology and economy in this field is now feasible, which makes the specific advantages of such natural materials accessible to a wide range of industrial uses.

With the method described and the apparatus intended for performing it, however, it is readily possible in an extension of the concept of the invention to produce multi-layer nonwoven fabrics without having to use a plurality of nonwoven fabric forming machines, each of which makes one ply or layer, as is required in the prior art:

Multi-layer nonwoven fabrics, especially in the automotive field, offer the possibility of producing molded parts for inner linings of natural fibers as well; the surface is sealed in vapor-proof fashion while being pressed, for instance to avoid the development of condensate, moisture and mold at critical points in the region of the natural fibers. This can be done by applying a film lining to the outside, for instance by the aforementioned combination of the nonwoven fabric with the coating belt 17 or 18. In the refinement described below, however, it is also possible to produce the cover layers of the nonwoven fabrics, for instance, from pure polymer fibers and to incorporate a high proportion of natural fibers only into the main layer in the middle. In the ensuing pressing operation, by suitably regulating the temperature and pressure, it can be assured that the outer layers, which comprise polymer fibers, will melt completely and in the pressing operation will then form a continuous or vapor-proof polymer skin on one or both sides. Compared with the application of a polymer film lining, such as the coating belt 17 and 18, this version has the advantage that the polymer fibers, as the three-layer nonwoven fabric is laid, will partly intersect or become matted with the natural fibers of the middle layer and as a result, a much more solid connection between the layers is formed than when a polymer film is applied as a lining on the outside. Molded parts produced in this way are capable of withstanding heavier loads than lined molded parts and thus increase the safety of passengers in the event of a crash.

For producing insulating material as well, a two- or three-layered structure of a nonwoven fabric can be advantageous, because polymer fibers combine with one another to form a solid layer more easily than do natural fibers. By making both cover layers of an insulating nonwoven fabric from polymer fibers, for instance, but making the actual insulating layer that represents the main cross section from 90% natural fibers, for instance, with only 10% polymer fibers acting as supporting and binding fibers, and by then passing this fiber composite through a thermal furnace, a nonwoven fabric is obtained that has two high-strength cover layers that are strongly fused by thermobonding, which hold the looser core of the natural fiber and polymer fiber mixture together like a skin and enable a simple incorporation.

FIG. 5 shows a sectional view through a third preferred embodiment of the apparatus of the invention, with which the described multi-layer structure of a fiber composite is possible without major effort or expense:

Instead of the single transverse distributor 11 (see FIG. 1), in this exemplary embodiment for producing a three-layer fiber composite, three transverse distributors 11A, 11B, 11C are correspondingly disposed in the metering bunker; their horizontal and vertical positioning and their feeding speed determine the relative thickness of the layers that are finally formed in the fiber composite. Each of these transverse distributors 11A, 11B, 11C serves to deliver one component of the multi-layer nonwoven fabric; in the last exemplary embodiment mentioned, for producing an insulating material, the transverse distributors 11A and 11C would consequently supply polymer fibers, while the transverse distributor 11B would supply a mixture of 90% long fibers and 10% polymer fibers.

Instead of the single material column M in the buildup of a homogeneous fiber layer as in FIG. 1, consequently three material layers MA, MB, MC form, one above the other, each in the applicable fiber composition. These material layers are delivered from the bottom belt 12 continuously to the discharge head A with its discharge devices 20 and 30 and are ejected by them to form the multilayer nonwoven fabric. The rotational speed of the discharge devices can be determined such that the "ejection parabolas" or individual fiber components of the various material layers extend in such a way that upon arrival on the forming belt, either a certain mixing of adjacent material layers or a sharp distinction between such material layers can be established selectively. The sharpness of the distinction between individual material layers 70A, 70B, 70C can also be further regulated by the speed and course of the air, with the aid of the negative-pressure chests 16.

For example, the upper discharge device can be adjusted to a higher rpm and the lower discharge device to a lower rpm than the rpm of the middle discharge devices, resulting in a wide spread via the ejection parabolas of the particles of the individual material layers, so that during the ejection, no overlap of ejection paths occurs, and thus a relatively sharp separation between the layers on the multi-layer nonwoven fabric is also attained.

Conversely, if diffuse boundaries between individual material layers in the multi-layer nonwoven fabric are desired, then the negative-pressure chests should be shut off, and the discharge devices should be controlled in terms of their rpm in opposite directions, so that on the one hand a longer float time is achieved, while on the other the ejection parabolas of the particles of the material layers, stacked one above the other, mix until their arrival on the forming belt, so that over the complete thickness of the resultant multiple nonwoven fabric, a continuous transition of material between the individual layers can be achieved.

Even in this kind of design, a selective imposition of the loading material on the natural fiber component (that is, the middle material layer in this exemplary embodiment) can also be achieved by a modified arrangement of the solids distributors 50 and nozzles 60.

The thus-formed nonwoven fabric can then be solidified by thermobonding, needling or the like, to enable its handling in the ensuing processing operations.

The apparatus according to the invention, in the third exemplary embodiment described, thus makes it possible, without major investment, to create a multi-layer fiber composite for producing a nonwoven fabric, in which the components and their transitions at the boundary layers can be selected or adjusted in a simple way by means of control parameters that are available anyway.

Especially in the last exemplary embodiment described above, it is even possible to dispense completely, or from time to time, with the addition of loading materials, for specific nonwoven fabric embodiments.

What is claimed is:

1. A method for producing a fiber composite containing fibers that constitute at least an essential component of the composite, the fibers having lengths between 20 and 150 mm and being delivered substantially above the height of a material column to a first discharge device through which the fibers are pulled out of the material column and then to a second discharge device which, for the production of a nonwoven fabric with the fibers, directly cooperates with the first discharge device for loosening, clearing and accelerating fibers pulled out of the first discharge device by imparting to the fibers a substantially horizontal acceleration, resulting in ejection of the fibers along parabolic trajectories with an adjustable ejection range established by adjusting operating parameters of the second discharge device, to thereby place and distribute the fibers on a forming belt.

2. The method of claim 1, in which at least one loading material is added to the fibers, characterized in that the loading material is added in a suspension space (S) of a fiber and air suspension, which space is formed between the second discharge device and the forming belt.

3. The method of claim 1, in which at least one loading material is added to the fibers, characterized in that the fibers are a component of a mixture in which binders, granulates or granular components occur as the loading material.

4. The method of claim 3, characterized in that the mixture comprises uncleaned natural fibers.

5. The method of claim 4 wherein the uncleaned natural fibers comprise hemp fibers, oiled linen fibers, flax fibers or fibers of jute, kenaf, sisal, or mixtures thereof.

6. The method of claim 3 in which the loading material includes shives, polymer parts, wood granulates, recycling foams.

7. The method of claim 1, characterized in that the fibers are compacted during their feeding to the first discharge device.

8. The method of claim 1, characterized in that the nonwoven fabric has two surfaces and at least one sealing agent for at least one of the two surfaces of the nonwoven fabric is added via the forming belt.

9. The method of claim 8, characterized in that a previously foamed material or an unfoamed material with an incorporated propellant is used as the sealing agent and binds to the surface of the nonwoven fabric that is to be coated, and optionally binds a cover layer or barrier layer to the nonwoven fabric.

10. An apparatus for performing the method of claim 1, having a metering bunker for the material column and having a plurality of first, vertically staggered discharge devices for engaging the fibers from the front of the material column and metering them, and having a forming belt guided below the first discharge devices, characterized in that the first discharge devices are disposed substantially vertically one above the other, and that a plurality of second discharge devices are provided, which are used for clearing, loosening and accelerating the fibers.

11. The apparatus of claim 10, characterized in that: the apparatus further comprises a transverse distributor for delivering the fibers to the metering bunker; the metering bunker has a bottomvia which the fibers are supplied to the first discharge devices; and the apparatus further comprises a compacting belt which extends obliquely downward between the transverse distributor and an upper end of the first discharge devices and that acts upon the material column that contains the fibers.

12. The apparatus of claim 10, characterized in that the first discharge devices comprise star wheels that are held spaced apart on a shaft, the star wheels having elements that point substantially radially to the shaft and front flanks that are oriented in a direction of rotation of the star wheels; that the second discharge devices have elements disposed in at least one of a starlike and thornlike form on a shaft for clearing, loosening and acceleration of the fibers; and that operative regions of the elements of the first and second discharge devices at least partly overlap or mesh with one another.

13. The method of claim 12 wherein the front flanks of the star wheels have a hooklike or crescent-shaped form.

14. The apparatus of claim 10, characterized in that first nozzles for introducing liquid loading materials into the fiber and air suspension are disposed above a discharge side of at least one of the discharge devices.

15. The method of claim 14 wherein the liquid loading materials comprise binder or flame retardant.

16. The apparatus of claim 10, characterized in that solids distributors for introducing solid loading materials into the fiber and air suspension are disposed above a discharge side of at least one of the discharge devices.

17. The method of claim 16 wherein the solid loading materials comprise shives, granulates or powdered binders.

18. The apparatus of claim 10, characterized in that the apparatus further comprises devices for introducing sealing agent, the devices comprising two nozzles disposed in a region below at least one of the discharge devices.

19. The apparatus of claim 10, characterized in that a first coating belt as a substrate/cover layer/barrier layer of the nonwoven fabric is guided on the forming belt.

20. The apparatus of claim 19, characterized in that the first coating belt is wider than the nonwoven fabric.

21. A method for producing a multi-layer fiber composite of claim 1, characterized in that the material column comprises at least two material layers located one above the other, which are simultaneously delivered to the discharge devices.

22. The method of claim 21, characterized by the use of polymer fibers in the material layers.

23. The method of claim 22, characterized in that the material layers include uppermost and lowermost material layers composed exclusively of polymer fibers.

* * * * *